United States Patent [19]

Guerra

[11] Patent Number: 4,704,751

[45] Date of Patent: Nov. 10, 1987

[54] DEVICE FOR SECURING SLATS TO THE FRAME OF A BEDSPRING

[75] Inventor: Fernando G. Guerra, Madrid, Spain

[73] Assignee: Fabricas Lucia, Antonio Betere, S.A., Madrid, Spain

[21] Appl. No.: 823,590

[22] Filed: Jan. 29, 1986

[30] Foreign Application Priority Data

Apr. 15, 1985 [ES] Spain ..... 286035
Apr. 15, 1985 [ES] Spain ..... 286036

[51] Int. Cl.[4] ..... A47C 23/06

[52] U.S. Cl. ..... 5/236 R; 5/237; 5/238

[58] Field of Search ..... 5/238, 237, 236 R, 236 B, 5/191, 239, 240, 241, 242, 243, 244, 245

[56] References Cited

U.S. PATENT DOCUMENTS

| | | | |
|---|---|---|---|
| 85,866 | 1/1869 | Stanford | 5/237 |
| 155,530 | 9/1874 | Lord et al. | 5/237 |
| 160,913 | 3/1875 | Ingersoll | 5/238 |
| 187,961 | 3/1877 | Burch | 5/237 |
| 461,687 | 10/1891 | McMaster | 5/238 |
| 474,018 | 5/1892 | LaLiberte | 5/238 |
| 570,788 | 11/1896 | Dumas | 5/238 |
| 3,553,745 | 1/1971 | Sproll | 5/236 |
| 4,136,411 | 1/1979 | Fanti | 5/191 |
| 4,567,615 | 2/1986 | Fanti | 5/238 |
| 4,573,226 | 3/1986 | Wittmann et al. | 5/237 |

FOREIGN PATENT DOCUMENTS

| | | | |
|---|---|---|---|
| 733096 | 10/1944 | Fed. Rep. of Germany | 5/236 |
| 1958100 | 5/1971 | Fed. Rep. of Germany | 5/191 |
| 2052056 | 6/1971 | Fed. Rep. of Germany | 5/191 |
| 3101215 | 8/1982 | Fed. Rep. of Germany | 5/236 |
| 1282875 | 2/1961 | France | 5/238 |
| 410864 | 6/1945 | Italy | 5/236 |

*Primary Examiner*—Gary L. Smith
*Assistant Examiner*—Carl M. DeFranco, Jr.
*Attorney, Agent, or Firm*—Ladas & Parry

[57] ABSTRACT

A device for securing slats to the frame of a bedspring comprised of a support partially encircling the end section of the slat and continuing in two straight sections longitudinal thereto, which constitute joining means to the frame since they are introduced in the holes of the inner wall thereof. The straight sections of the support are secured in a ferrule of the slat, in the bottom of which there has previously been placed damper means which absorbs the pressure of the slat. The slats constituting the support base for the mattress can have different widths, depending on the weight to be supported, according to their location, thereby reinforcing the corresponding zones.

9 Claims, 8 Drawing Figures

A-B

DEVICE FOR SECURING SLATS TO THE FRAME OF A BEDSPRING

BACKGROUND OF THE INVENTION

The securing device of the invention is applicable to those bedsprings comprised of a frame having a general rectangular shape with rounded edges, although preferably tubular and consisting of two U-shaped semiparts with faced legs, joined at their ends.

The support base for the mattress is obtained by a plurality of resilient arched slats positioned parallel to one another and transversal to the frame, the ends of which are secured to the said frame.

The manner in which the slats are joined to the frame presents problems, not only relating to the mounting of the said slats, but also to the malfunctioning thereof, unavoidable oscillations thereof, and undesirable friction at the ends of the slats giving rise to a premature wear and breakage.

The ends of the slats of conventional bed-spring are introduced into holes provided therefor in the frame, and all the slats forming the support base for the mattress are alike, not taking into account that, depending on the uses to be made, determined areas of the bedspring must resist higher stresses than others, being subject to a greater strain and, therefore, those slats which are encountered in the lumbar area have a higher flexure. In other cases, depending precisely on the needs of the user, the slats located at the dorsal and/or extremity zones, must be stiffer than the rest, and the reinforced zones must even cover the entire surface of the bedspring.

SUMMARY OF THE INVENTION

To overcome the said problems presented by bedsprings incorporating conventional slats, the present invention provides a device for securing slats to the frame of the bedspring, insuring a perfect resiliency of the slats, which do not experiment any undesirable oscillation, as well as preventing unnecessary frictional noises.

Thus, the slats constituting the support base for the mattress have, before being utilised, a minimum curvature and the distance between their ends is slightly shorter than that existing between the inner faces of the side members of the frame. The slats are joined to the frame, according to the device of the invention, by means of a support, preferably, a rod, which partially encircles the section of the slat, the ends of which extend in straight portions, longitudinal to the slat and, therefore, perpendicular to the frame, crossing the frame since they pass through the holes made in the inner wall thereof.

Contributing to the secure fixing of the support to the slat, and to prevent undesirable oscillations, the longitudinal parallel arrangement of the straight ends of the support is secured and blocked by a ferrule, preferably of plastic, into which the end of the slat adapts itself perfectly. The ferrule is provided at its lower wall with two grooves in which the said ends are housed and guided to be mounted, which ends protrude outwards through the bottom wall of the ferrule. Therefore, there are only two points of support which constitute the means for joining each end of the slat to the frame, achieving, apart from a flexible joining for the resilient function of the entire slat, a secure fastening without clearances which originate other undesirable lateral oscillations.

To absorb the pressure exerted by the slat against the frame, through the ferrule, the invention proportions the arrangement inside this latter of a damper means comprised of a rubber orthohedral piece which, simultaneously as it performs its damping function, prevents possible frictional noises.

The end of the slat housed in the ferrule is provided with a stepped recess, at least at its sides, constituting abutt against the introduction of the supports, and after the ferrule has been embedded, a smooth surface is obtained, which is not provided with projections into which the mattress and sheets may be hooked.

According to the invention, which has taken into account the physical needs, due both to the anatomical as well as the clinical nature of the user, and the need to rest, which differs in each individual, at least one of the slats constituting the support base for the mattress, must be wider than the rest and it must be positioned precisely at the central zone of the bedspring as a lumbar reinforcement, although other wider slats could be positioned for the dorsal and extremity zones. This reinforcement may also be used for the whole body, comprised of substantially double-width slats which are joined to the frame by means of two securing devices for each end, wherefore the slat is secured by means of four points of support at each side.

BRIEF DESCRIPTION OF THE DRAWINGS

A better understanding of this specification will be derived from the accompanying drawings which, in an illustrative but not limiting manner, represent.

DESCRIPTION OF A PREFERRED EMBODIMENT

Figure 1:
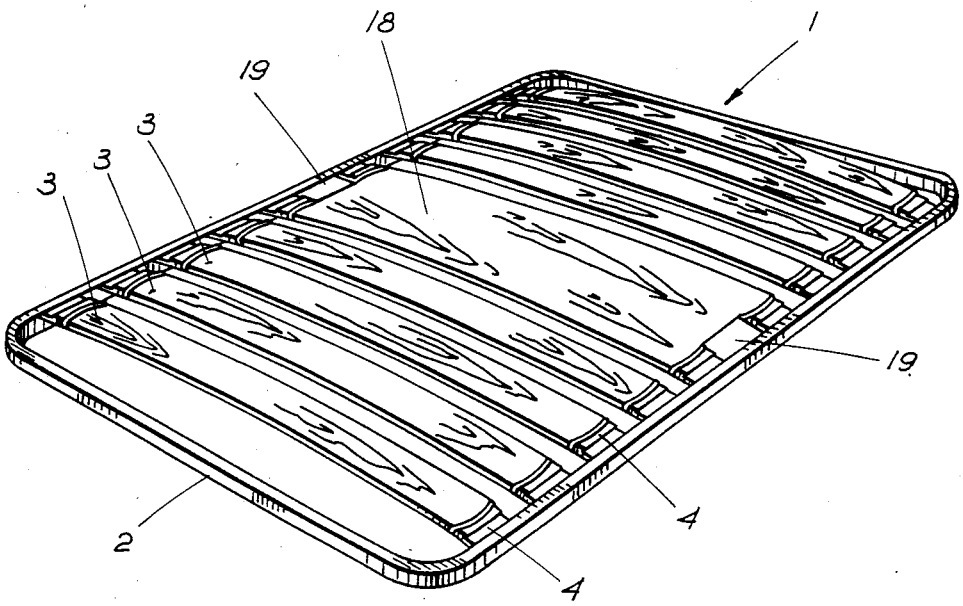
FIG. 1 is a perspective view of a slatted bedspring including the securing device of the invention.

Referring to the drawings and specifically to FIG. 1, it can be seen that the bedspring 1 is comprised of a frame 2 consisting preferably of a special steel tubular profile composed of two U-shaped halves joined at their ends by means of joining sockets.The support base for the mattress is comprised of a plurality of resilient arched slats 3, preferably cladded wooden slabs of natural beechwood, in order to attain the maximum resiliency. The slats 3 are joined to the frame 2 by means of securing devices 4 placed at their ends.

Figure 2:
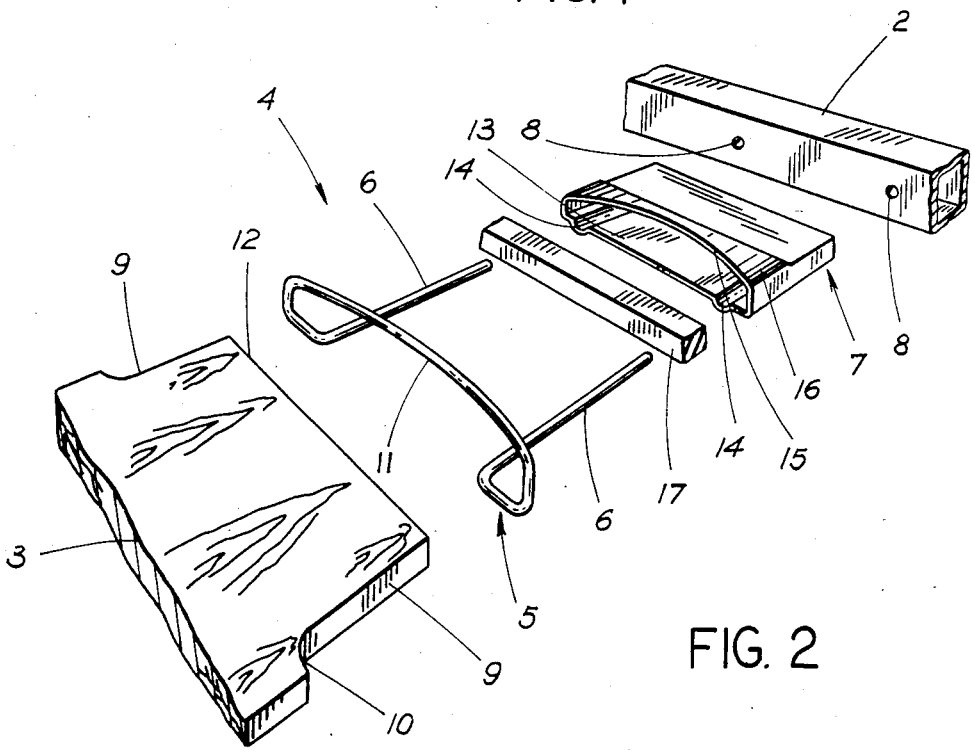
FIG. 2 is an exploded perspective view of the securing device of the invention, further including partially a portion of the slat and of the bed-spring frame.
Figure 3:
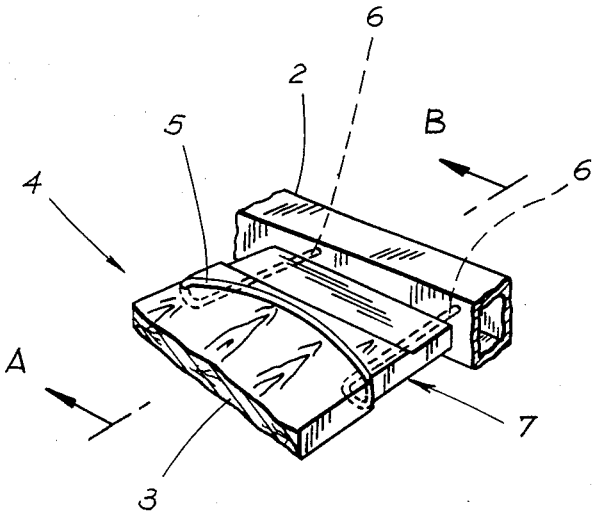
FIG. 3 is a perspective view of the elements shown in FIG. 2, in an assembled position.

Referring to FIG. 2, the slat 3 is secured to the frame 2 by means of a support 5 encircling the end section of the slat 3 and including two straight portions 6, longitudinal to the slat and parallel to each other, and a ferrule 7 which, whilst being secured to the end of the slat, blocks the straight portions 6 of the support 5.

Both ends of the support 5 are introduced in the frame 2 since they pass through holes 8 made in the inner wall thereof, thereby constituting hinged supports.

Once the support 5 has been placed at the end of the slat 3, it must be prevented from moving towards the central zone thereof to avoid its accidental uncoupling from the frame 2. Thus, according to the invention, at least the side edges of the slat have stepped recesses 9 constituting the butt means 10 against the introduction of the support 5.

Since the ferrule is embedded in this recessed end zone of the corresponding slat 3, its outer periphery is not provided with projections as a continuity of the slat 3, wherefore the mattress and the sheet cannot possibly be hooked.

Figure 5:
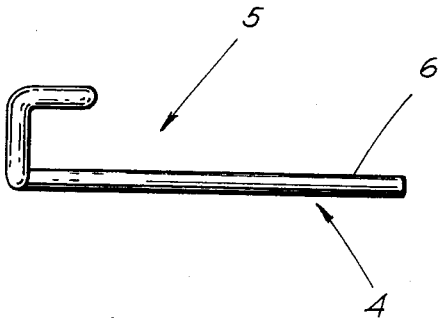
FIGS. 5, 6 and 7 are front, side elevational and plan views of the support incorporated in the device of the invention.
Figure 6:
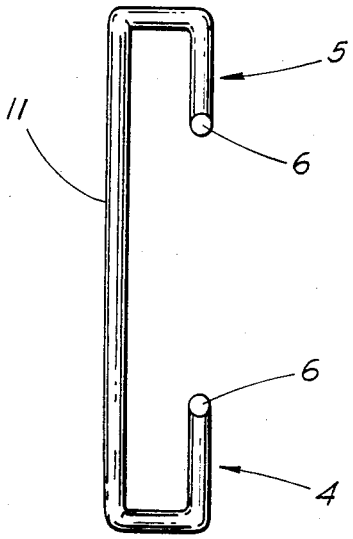
Figure 7:
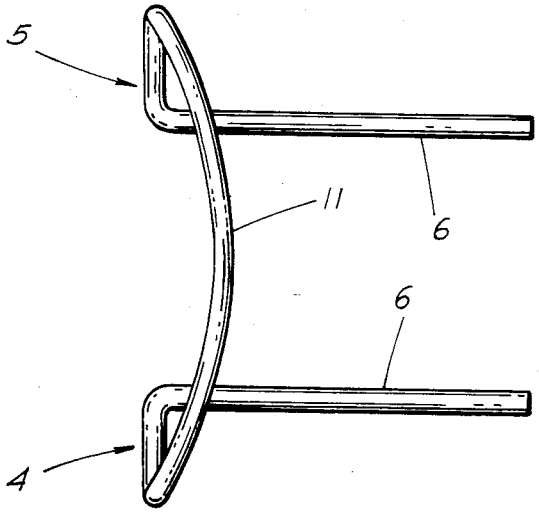

Although the support 5 could have any shape to firmly encircle the slat 3, for which purpose it must only be provided with the straight portions 6 to be inserted in the frame 2, according to the invention and for this embodiment, the said support 5 must adopt a geometric shape as shown in detail in FIGS. 5 to 7, whereby the maximum resilient joining is attained. As can be observed from these figures, the said support 5 is comprised of a C-shaped gaged rod, the ends of which C are disposed on the lower face of the slat 3, at an equal distance from its longitudinal edges, these ends continuing in the straight portions 6. The entire length of the central section 11 of the C-shaped part of the support 5 is curved in the same plane as the slat 3 and is directed towards the extreme edge 12 thereof.

The ferrule 7, whose main task is that of blocking the straight portions 6 to prevent the slat 3 from having undesirable oscillations, is provided at its lower wall 13 with grooves 14, longitudinal to the slat 3, in which the said straight portions 6 of the support 5 are firmly received and guided during assembly.

Figure 4:
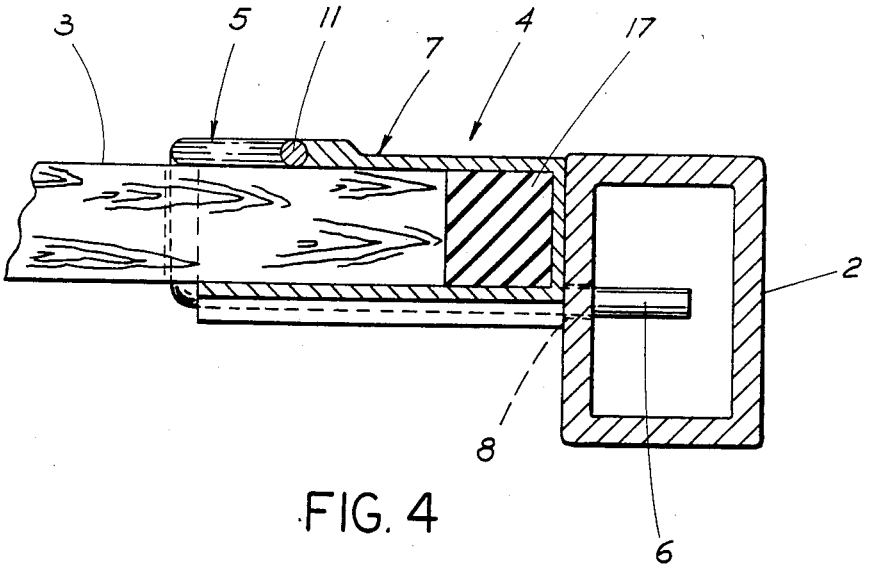
FIG. 4 is a longitudinal elevational section of FIG. 3 taken along line A–B.

In accordance with the invention, the upper free edge of the ferrule 7 has an arched recess 15, adjusted to the section 11 of the support 5, this upper wall also preferably having a thickening 16 which, apart from performing a reinforcing function, smooths the stepping which would be formed between the upper surface of the ferrule and the section 11 of the support 5, thereby preventing the mattress and sheet from being hooked, as can clearly be seen in FIG. 4 corresponding to a longitudinal section of the assembly.

To absorb the pressure of the slat 3 on the bottom of the ferrule 7 and on the frame 2, during the operative phase thereof, damper means 17, preferably of rubber or the like, is positioned in the bottom of the ferrule 7, as illustrated in FIG. 4, further avoiding possible noises.

Reverting again to FIG. 1, and so that all the slat 3 constituting the base for the mattress do not have an analogous geometry, as in the case of this type of bedsprings, it can be seen that one central slat 18, wider than the others is placed at the position corresponding to the lumbar zone of the user. In this embodiment, the width is substantially equal to three times that of the slats 3, being secured to the frame 2 by means of two joining means for each side, comprised of a pair of securing devices 4 placed close to the respective longitudinal ends of this slat 18. To adapt the devices 4 to each end of the slat 18, the extreme edges thereof have grooves 19, forming collaterally pins analogous to the extreme portions of the slats 3 also provided with outer stepped recesses 9.

Figure 8:
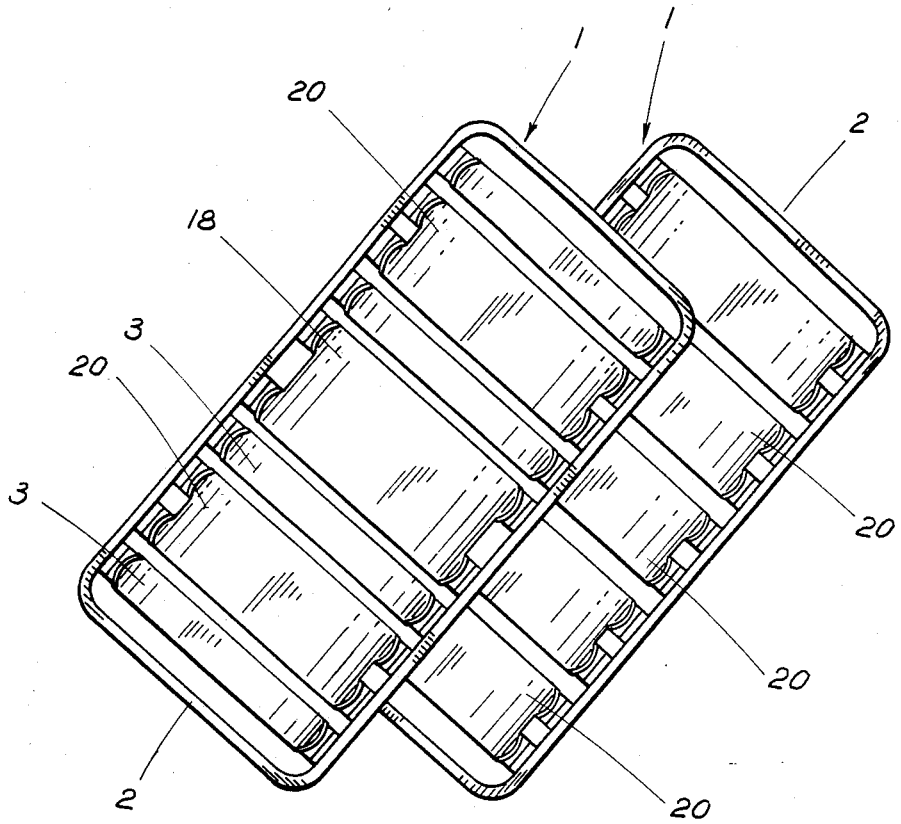
FIG. 8 is a plan view illustrating, by way of example, two bedsprings in accordance with the invention, presenting wider reinforcing slats for the lumbar, dorsal and extremity areas, and reinforced slats for the whole body, respectively, the former positioned on the latter.

FIG. 8 shows a plan view of two embodiments of bedsprings, according to the invention, the upper partially hiding the lower, from which it can be seen that due to the user's need, not only is the lumbar zone reinforced by the wider slat 18, but the dorsal and extremity zones are also reinforced by slats 20, similar to slats 18, although preferably slightly narrower.

The lower bedspring of FIG. 18 has an arrangement of slats analogous to those referenced 20, to obtain a support surface for the mattress with reinforcements for the whole body of the user.

I claim:

1. A bed slat securing device for securing slats to the frame of a bedspring, said slats acting as a support base for a mattress, said bedspring having a substantially rectangular frame, said frame being tubular in cross-section wherein a plurality of resilient arched slats are positioned parallel to one another and to the minor sides of the frame, ends of said slats secured to the frame by a securing device, said securing device comprised of a support, attached to each end of said slat, said slat support comprising a rod having a C-shaped section which partially encircles the slat and free end sections continuing in straight sections perpendicular to the C-shaped secton and parallel to the slat a ferrule, said ferrule which receive and guide receiving the end of the slat and having a bottom wall with arched grooves rod, the support rod said straight sections of the support protruding outwards therefrom through corresponding holes in the bottom wall, and a damper means, said damper means comprised of a piece housed in the bottom of said ferrule between the end of the slat and the bottom of the ferrule and on which said slat rests; the ends of the support rod being inserted in the frame tubular through holes provided in an inner wall thereof.

2. A bed slat securing device for securing slats to the frame of a bedspring according to claim 1, in which the said support rod is C-shaped having a central section and proximal ends, said support rod partially encircling the slats, the central section of which is disposed on an upper surface of the slats and is provided with a curvature coplanar to the slats and directed towards the proximal end thereof, its free ends extending in the said straight sections.

3. A bed slat securing device for securing slats to the frame of a bedspring according to claim 1, in which the ends of each slats have a dovetail like shaped recess as an introduction butt for the support and which absorbs, at least collaterally, the thickness of the rod of the support and in which the ferrule is housed.

4. A bed slat securing device for securing slats to the frame of a bedspring according to claim 1, in which the ferrule has an upper wall, said upper wall of the ferrule having a thickening and edge, at one end thereof, said edge being provided with an arched recess corresponding to the C-shaped section rod of the support; the lower wall of which is provided with two grooves in which the straight sections of the support rod are housed.

5. A bed slat securing device for securing slats to the frame of a bedspring according to claim 1, in which all the slats of the bedspring have the same width.

6. A bed slat securing device for securing slats to the frame of a bedspring as defined in claim 1, wherein said rectangular frame is tubular in shape with rounded edges.

7. A bed slat securing device for securing slats to the frame of a bedspring as defined in claim 1, wherein said ferrule is comprised of a plastic material.

8. A bed slat securing device for securing slats to the frame of a bedspring as defined in claim 1, wherein said damper is comprised of rubber.

9. A bed slat securing device for securing slats to the frame of a bedspring according to claim 1, wherein at least one of the slats of the bedspring is wider in width relative to the other slats and can be positioned at least as an anatomical reinforcement, fixed to the frame by two securing devices at each end, since the extreme edges thereof are provided with a central recess.

* * * * *